US006163662A

United States Patent [19]

Martin et al.

[11] Patent Number: 6,163,662

[45] Date of Patent: Dec. 19, 2000

[54] IMAGE FORMING DEVICES, FUSING ASSEMBLIES, AND METHODS OF FORMING AN IMAGE USING CONTROL CIRCUITRY TO CONTROL FUSING OPERATIONS

[75] Inventors: Michael J. Martin, Boise; John W. Huffman, Meridian; Nancy Cernusak, Eagle; Jeffrey S. Weaver, Boise; James G. Bearss, Boise; Thomas Camis, Boise, all of Id.

[73] Assignee: Hewlett-Packard Company, Palo Alto, Calif.

[21] Appl. No.: 09/348,650

[22] Filed: Jul. 6, 1999

[51] Int. Cl.[7] ..... G03G 15/00

[52] U.S. Cl. ..... 399/45; 399/69

[58] Field of Search ..... 399/67, 45, 68, 399/389, 69; 219/216

[56] References Cited

U.S. PATENT DOCUMENTS

| | | | |
|---|---|---|---|
| 4,610,530 | 9/1986 | Lehmbeck et al. . | |
| 4,822,977 | 4/1989 | Leising et al. | 219/216 |
| 5,361,124 | 11/1994 | Rowe et al. | 219/216 X |
| 5,486,903 | 1/1996 | Kanno et al. . | |
| 5,512,992 | 4/1996 | Kim et al. | 219/216 |
| 5,557,427 | 9/1996 | Kamiya | 358/496 |
| 5,568,229 | 10/1996 | Szlucha | 219/216 |
| 5,689,757 | 11/1997 | Ferrante et al. | 399/45 |
| 5,822,651 | 10/1998 | Yim et al. | 399/66 |
| 5,887,219 | 3/1999 | Eom | 399/45 |
| 5,905,925 | 5/1999 | Kawabata et al. | 399/45 |
| 5,934,140 | 8/1999 | Jackson et al. | 399/389 X |
| 5,956,543 | 9/1999 | Aslam et al. | 399/45 |
| 5,966,559 | 10/1999 | May et al. | 399/45 |

*Primary Examiner*—William J. Royer

[57] ABSTRACT

The present invention relates to image forming devices, fusing assemblies and methods of forming an image. According to one aspect of the invention, an image forming device includes a housing including a media path configured to guide media in a downstream direction within the housing; an input device configured to receive an image; a developing assembly adjacent the media path and configured to provide developing material; a sensor adjacent the media path and configured to determine a qualitative characteristic of the media and to generate a signal indicative of the qualitative characteristic; and a fuser adjacent the media path and configured to adjust a fusing parameter responsive to the signal and to fuse the developing material corresponding to the image to the media and according to the fusing parameter.

25 Claims, 6 Drawing Sheets

IMAGE FORMING DEVICES, FUSING ASSEMBLIES, AND METHODS OF FORMING AN IMAGE USING CONTROL CIRCUITRY TO CONTROL FUSING OPERATIONS

FIELD OF THE INVENTION

The present invention relates to image forming devices, fusing assemblies and methods of forming an image.

BACKGROUND OF THE INVENTION

Electrophotographic processes for forming images upon media are well known in the art. Typically, these processes include an initial step of charging a photoreceptor which may be provided in the form of a drum or continuous belt having photoconductive material. Thereafter, an electrostatic latent image may be produced by exposing the charged area of the photoreceptor to a light image using a light-emitting diode array, or scanning the charged area with a laser beam in exemplary configurations.

Particles of toner may be applied to the photoreceptor surface upon which the electrostatic latent image is disposed such that the toner particles are transferred to the electrostatic latent image. Thereafter, a transfer step occurs wherein the toner particles are transferred from the photoreceptor to the media while maintaining the shape of the image formed upon the photoreceptor. A fusing step is utilized to fix the toner particles in the shape of the image to the media. A subsequent step can include cleaning or restoring the photoreceptor for a next printing cycle.

Operational parameters greatly affect the final print quality of the toner image supplied to the media. For example, an effective temperature in the fuser nip is vital to ensure optimized image quality and achievable print. Two variables in printing media that affect the effective temperature in the fuser nip are basis weight and water content. These two variables manifest themselves as differences in dielectric thickness, heat capacity and thermal conductivity for a given media in an environment.

In some conventional arrangements, a user can manually adjust fuser temperatures using a control panel or software. Typically, such adjustments are made after problems in fusing quality are noticed. This is disadvantageous inasmuch as monitoring of printing by personnel is required.

The above conventional image forming system configurations have associated drawbacks of requiring knowledge of the user to implement transfer and fusing adjustments as well as knowledge of the proper adjustment to improve transfer and fusing quality. Therefore, a need exists to provide image forming devices and methods which provide improved print quality for different types of media by limiting fuser generated defects.

SUMMARY OF THE INVENTION

The present invention relates to image forming devices, fusing assemblies and methods of forming an image. According to a first aspect of the invention, an image forming device comprises: a housing including a media path configured to guide media in a downstream direction within the housing; an input device configured to receive an image; a developing assembly adjacent the media path and configured to provide developing material; a sensor adjacent the media path and configured to determine a qualitative characteristic of the media and to generate a signal indicative of the qualitative characteristic; and a fuser adjacent the media path and configured to adjust a fusing parameter responsive to the signal and to fuse the developing material corresponding to the image to the media and according to the fusing parameter.

Another aspect of the present invention includes a fusing assembly adjacent a media path of an image forming device comprising: a sensor configured to monitor at least one of the heat capacitor and thermal conductivity of media traveling in a downstream direction along a media path of an image forming device and to generate a characteristic signal responsive to the monitoring; a fuser configured to fuse developing material to the media according to a fusing parameter; and a controller configured to receive the characteristic signal from the sensor and to output a control signal responsive to the characteristic signal to the fuser to adjust the fusing parameter.

According to another aspect, the present invention includes a fusing assembly adjacent a media path of an image forming device comprising: a sensor configured to monitor surface finish of the media traveling in a downstream direction along a media path of an image forming device and to generate a characteristic signal responsive to the monitoring; a fuser configured to fuse developing material to the media according to a fusing parameter; and a controller configured to receive the characteristic signal from the sensor and to output a control signal responsive to the characteristic signal to the fuser to adjust the fusing parameter.

A method of forming an image upon media according to another aspect comprises: providing an image forming device; fusing developing material to media corresponding to an image to be printed and according to a fusing parameter; monitoring a qualitative characteristic of the media; and adjusting the fusing parameter responsive to the monitoring.

Other features and advantages of the invention will become apparent to those of ordinary skill in the art upon review of the following detailed description, claims, and drawings.

DESCRIPTION OF THE DRAWINGS

Preferred embodiments of the invention are described below with reference to the following accompanying drawings.

FIG. 9 is functional block diagram illustrating exemplary operations of the image forming device.

DETAILED DESCRIPTION OF THE INVENTION

This disclosure of the invention is submitted in furtherance of the constitutional purposes of the U.S. Patent Laws "to promote the progress of science and useful arts" (Article 1, Section 8).

The protection sought is not to be limited to the disclosed embodiments, which are given by way of example only, but instead is to be limited only by the scope of the appended claims.

Figure 1:
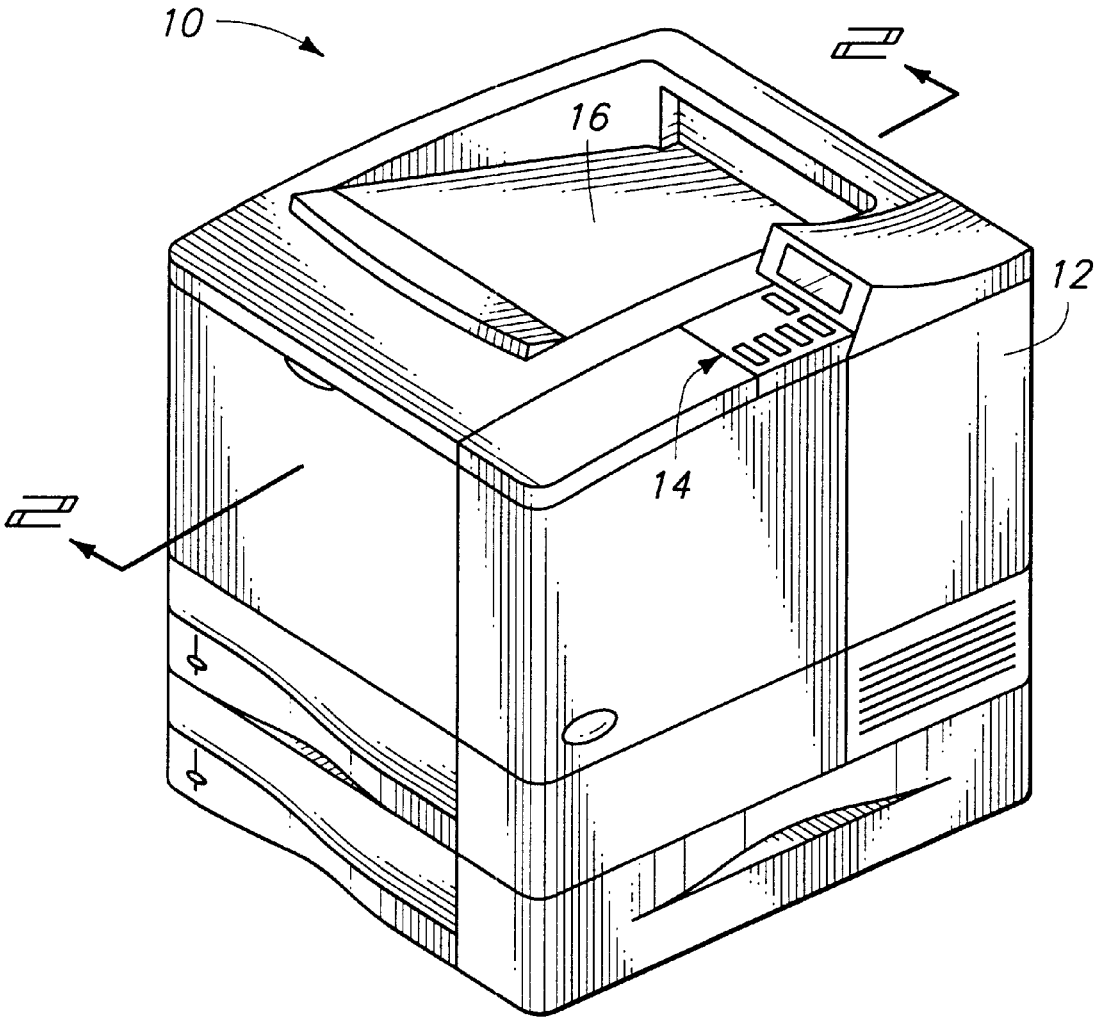
FIG. 1 is an isometric view of an image forming device.

Referring to FIG. 1, an exemplary image forming device 10 embodying the present invention is illustrated. The depicted image forming device 10 comprises an electrophotographic printer. In alternative embodiments, image forming device 10 is provided in other configurations, such as facsimile or copier configurations.

The illustrated image forming device 10 includes a housing 12 arranged to house internal components (not shown in FIG. 1). A user interface 14 is provided upon an upper surface of housing 12. User interface 14 includes a key pad and display in an exemplary configuration. A user can control operations of image forming device 10 utilizing the key pad of user interface 14 or via driver software from a computer (not shown) coupled with image forming device 10. In addition, the user can monitor operations of image forming device 10 using the display of user interface 14. An outfeed tray 16 is also provided within the upper portion of housing 12. Outfeed tray 16 is arranged and positioned to receive outputted printed media. Outfeed tray 16 provides storage for convenient removal of the printed media from image forming device 10.

Figure 2:
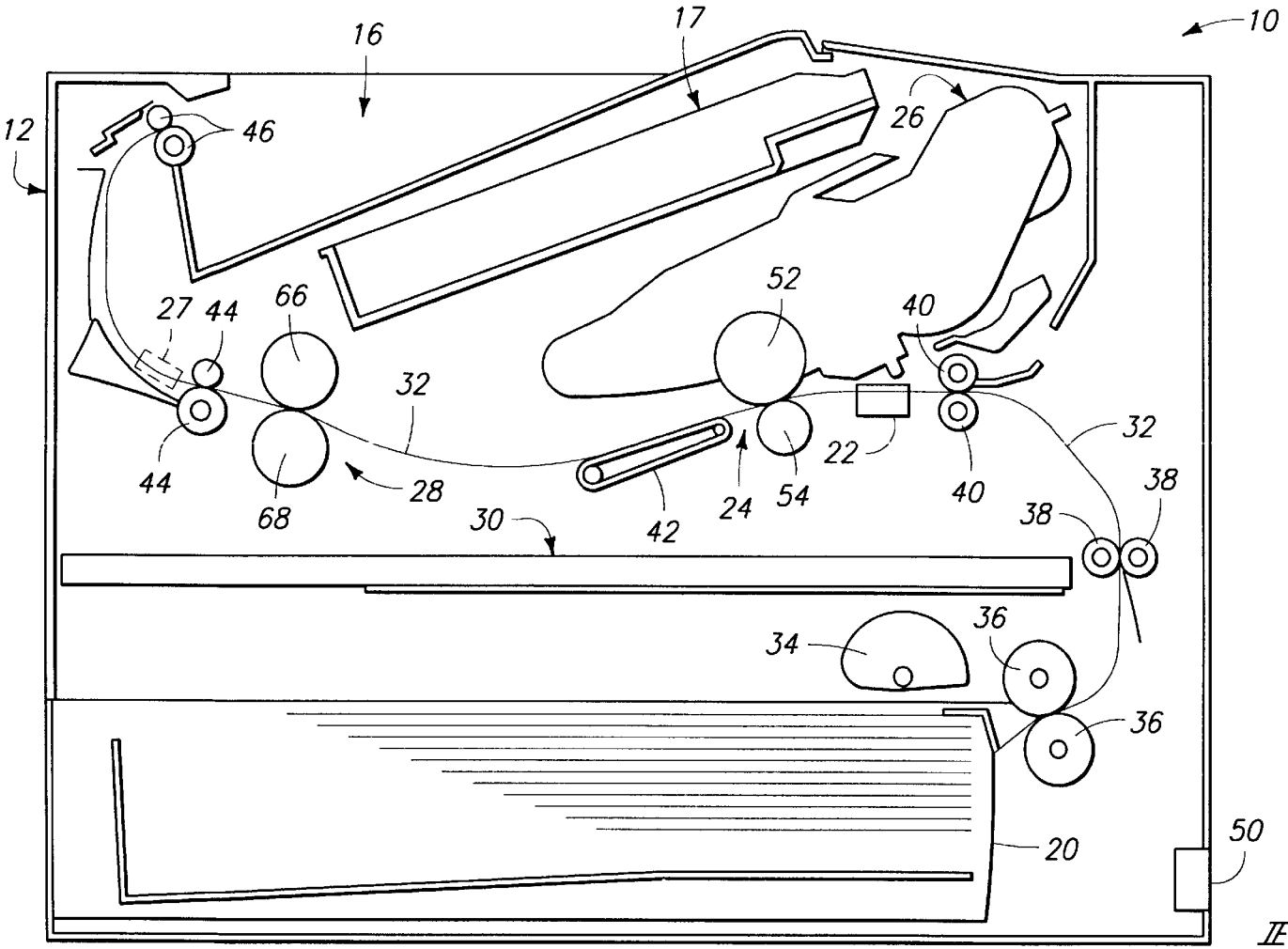
FIG. 2 is a cross-sectional view of the image forming device of FIG. 1.

Referring to FIG. 2, various internal components of an exemplary configuration of image forming device 10 are shown. The depicted image forming device 10 includes a laser scanner 1 7, media supply tray 20, sensor 22, imager 24, developing assembly 26, fuser 28, and controller 30. A media path 32 is provided through image forming device 10. Plural rollers are provided along media path 32 to guide media in a downstream direction from media supply tray 20 towards outfeed tray 16. More specifically, a pick roller 34, feed rollers 36, transport rollers 38, registration rollers 40, conveyor 42, delivery rollers 44, and output rollers 46 are arranged as shown to guide media along media path 32.

Image forming device 10 includes an input device 50 configured to receive an image in the described printer configuration. An exemplary input device 50 includes a parallel connection coupled with an associated computer or network (not shown). Such a coupled computer or network could provide digital files (e.g., page description language (PDL) files) corresponding to an image to be produced within image forming device 10. The received files from input device 50 may be formatted using formatter circuitry (not shown).

Developing assembly 26 is positioned adjacent media path 32 and provides developing material, such as toner, for forming images. Developing assembly 26 is preferably implemented as a disposable cartridge for supplying such developing material.

Sensor 22 is positioned adjacent media path 32 and determines a qualitative characteristic of media being printed upon and generates a signal indicative of the qualitative characteristic. As described below, sensor 22 can be configured to monitor qualitative characteristics such as heat capacity, thermal conductivity and surface roughness or finish of the media. Sensor 22 is preferably positioned to cause minimal vibration of media sheets 18 being monitored so as to not interfere with the static adhesion of developing material 61 to media sheets 18.

Imager 24 is positioned adjacent media path 32 and provides developing material upon media passing adjacent imager 24 corresponding to a received image via input 50. Fuser 28 is adjacent media path 32 and is located downstream from imager 24 within image forming device 10. Fuser 28 fuses the developing material corresponding to the received image to the media.

Figure 3:
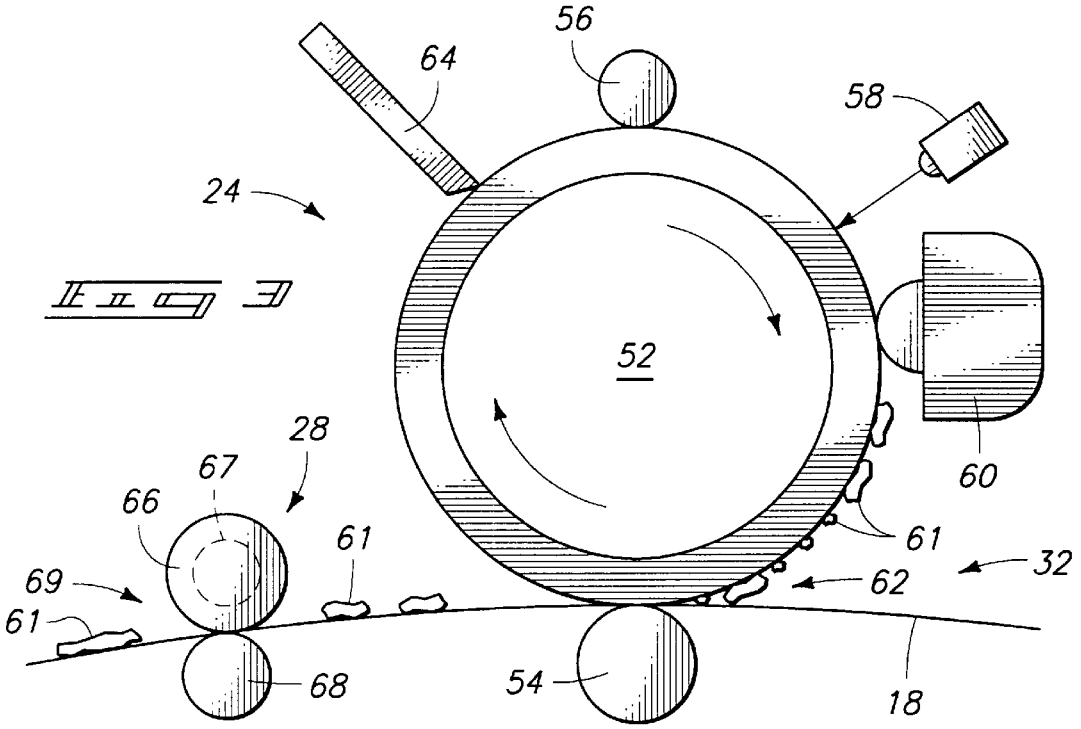
FIG. 3 is an illustrative representation of an imager and a fuser of the image forming device.

Referring to FIG. 3, further details of image forming operations of image forming device 10 are described. The depicted imager 24 includes an imaging roller 52 and transfer roller 54. Imaging roller 52 is a photoconductor or photosensitive drum which is insulative in the absence of incident light and conductive when illuminated. Imaging roller 52 may be implemented as a belt in an alternative configuration.

Imaging roller 52 rotates in a clockwise direction with reference to FIG. 3. The rotating imaging roller 52 is charged uniformly by a charging device such as charging roller 56. Charging roller 56 provides a negative charge upon the surface of imaging roller 52 in the described configuration. A laser device 58 scans across the charged surface of imaging roller 52 and writes an image to be formed by selectively discharging areas upon imaging roller 52 where toner is to be printed. A developer 60 applies developing material 61 adjacent imaging roller 52. Negatively-charged developing material 61 is attracted to discharged areas upon imaging roller 52 corresponding to the image and repelled from charged areas thereon.

A media sheet 18 traveling along media path 32 passes intermediate imaging roller 52 and transfer roller 54 at a transfer nip 62. The developed image comprising the developing material is transferred to media sheet 18 within transfer nip 62. A bias voltage is applied to transfer roller 54 positioned below passing media sheet 18 in FIG. 3. Application of the voltage bias to transfer roller 54 induces an electric field through media sheet 18. The magnitude of the induced field is determined by the bias voltage, the resistivity of media sheet 18 and the dielectric thickness of media sheet 18.

The induced electric field causes the developing material 61 to move from imaging roller 52 to media sheet 18. Residual developing material (not shown) upon imaging roller 52 may be removed at cleaning station 64 to prepare imaging roller 52 for the application of a subsequent image. Control of transfer operations responsive to media properties is described in detail in a U.S. patent application entitled "Image Forming Devices, Imaging Assemblies and Methods of Forming an Image", filed on the same day as the present U.S. patent application, naming Jeffrey S. Weaver, James G. Bearss and Thomas Camis as inventors, having U.S. patent application Ser. No. 09/348,149, and incorporated herein by reference.

Fuser 28 is positioned downstream of imager 24. Media travels in a downstream direction from imager 24 to fuser 28. Fuser 28 includes a fusing roller 66 and a pressure roller 68. Fusing roller 66 and pressure roller 68 are in contact at fuser nip 69. Media sheet 18 having developing material 61 thereon passes from imager 24 to fuser 28.

Media sheet 18 passes fusing roller 66 and pressure roller 68 at fuser nip 69. Fusing roller 66 preferably includes an internal heating element 67 to impart heat flux to developing material 61 upon media sheet 18 as well as media sheet 18 itself. Application of such heat flux from fusing roller 66 fuses developing material 61 cohesively to media sheet 18. Temperatures of fusing roller 66 for providing optimum fusing are dependent upon the properties of developing material 61, the velocity of media sheet 18, the surface finish of media sheet 18, and the thermal conductivity and heat capacity of media sheet 18.

Figure 4:
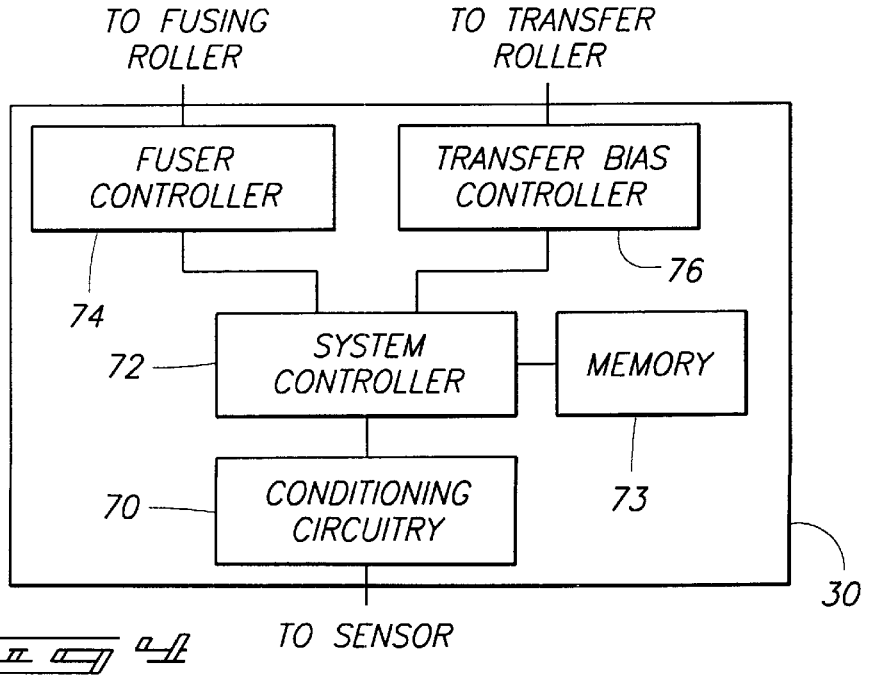
FIG. 4 is a functional block diagram of exemplary control circuitry of the image forming device.

Referring to FIG. 4, components of control circuitry 30 are illustrated. The depicted embodiment of control circuitry 30 includes conditioning circuitry 70, a system controller 72, a memory 73, a fuser controller 74 and a transfer bias controller 76. Control circuitry 30 can also include other circuitry, such as analog power circuits.

In the depicted arrangement, conditioning circuitry 70 is coupled with sensor 22, fuser controller 74 is coupled with fusing roller 66 and transfer bias controller 76 is coupled with transfer roller 54 (sensor 22, fusing roller 66 and transfer roller 54 are shown in FIG. 2).

System controller 72 comprises a digital microprocessor or microcontroller to implement print engine control operations in the described embodiment. System controller 72 is configured to execute a set of instructions provided as software or firmware of control circuitry 30. Fuser controller 74 operates to control fusing roller 66 and transfer bias controller 76 operates to control transfer roller 54.

Fusing roller 66 of fuser 28 operates to fuse the developing material the media according to a fusing parameter. An exemplary fusing parameter is fusing temperature of fusing roller 66. The fusing parameter may be adjusted to provide optimized printing regardless of the type of media being printed upon in accordance with one aspect of the present invention.

Sensor 22 is provided in the described embodiment to monitor the media for controlling fuser 28. More specifically, sensor 22 is configured to determine or monitor a qualitative characteristic of the media and output a characteristic signal indicative of the qualitative characteristic to conditioning circuitry 70. Control circuitry 30 receives characteristic signals generated from sensor 22 and controls adjustment of a fusing parameter of fuser 28 responsive to the signal. In another embodiment, sensor 22 additionally monitors ambient conditions (e.g., temperature, humidity, etc.) and control circuitry 30 controls adjustment of the fusing parameter responsive to the monitoring of ambient conditions in conjunction with the media monitoring.

Further, control circuitry 30 can preferably monitor the fusing parameter (e.g., fusing temperature) and control fusing roller 66 responsive to the monitoring using fuser controller 74. Characteristic signals outputted from sensor 22 define a preferred fusing parameter for a given media type. Control circuitry 30 can monitor the performance of fusing roller 66 to verify operation thereof according to the specified fusing parameter. Control circuitry 30 can adjust operations (e.g., generation of heat via heater 67) of fusing roller 66 to provide operation of fuser 28 at the proper fusing parameter as determined by the type of media.

As previously mentioned, sensor 22 applies characteristic signals to control circuitry 30. Conditioning circuitry 70 of control circuitry 30 receives the outputted characteristic signals from sensor 22 and applies respective conditioned signals to system controller 72. Exemplary conditioning circuitry 70 can include filtering circuitry to remove unwanted spikes, noise, etc.

Memory 73 stores a look-up table which includes a plurality of values which may be applied to fuser controller 74 to control fusing operations. As described further below, system controller 72 generates indices responsive to characteristic signals outputted from sensor 22 to index the look-up table stored within memory 73. The look-up table values may be empirically derived to produce optimum fuser settings for fuser controller 74 and fuser 28 using media of known parameters and having known qualitative characteristics. Thereafter, such look-up table values are accessed in real-time to provide optimized printing or other image formation within image forming device 10.

System controller 72 applies control signals to fuser controller 74 responsive to the look-up table values. The look-up table values can comprise current power requirements for fuser 28. Fuser controller 74 confirms there are no thermal errors at fuser 28 and sends the requested power requirements to fuser 28 responsive to the characteristic signals to control fuser 28. Thereafter, the appropriate fusing parameter (e.g., fusing temperature) is adjusted responsive to power requirement control signals received from controller 30.

Sensor 22 (shown in FIG. 2) monitors a qualitative characteristic of media traveling along media path 32 and generates a characteristic signal indicative of the qualitative characteristic. Fusing quality of developing material 61 is dependent to some degree upon surface roughness of media sheet 18. Other properties that contribute to fusing quality are media thickness or weight, material properties and moisture content. Exemplary configurations of sensor 22 for individually measuring at least one of surface finish, heat capacity and thermal conductivity are illustrated within FIG. 5–FIG. 7. One or more of sensor configurations 22*a*–22*c* may be utilized in a single image forming device 10.

Figure 5:
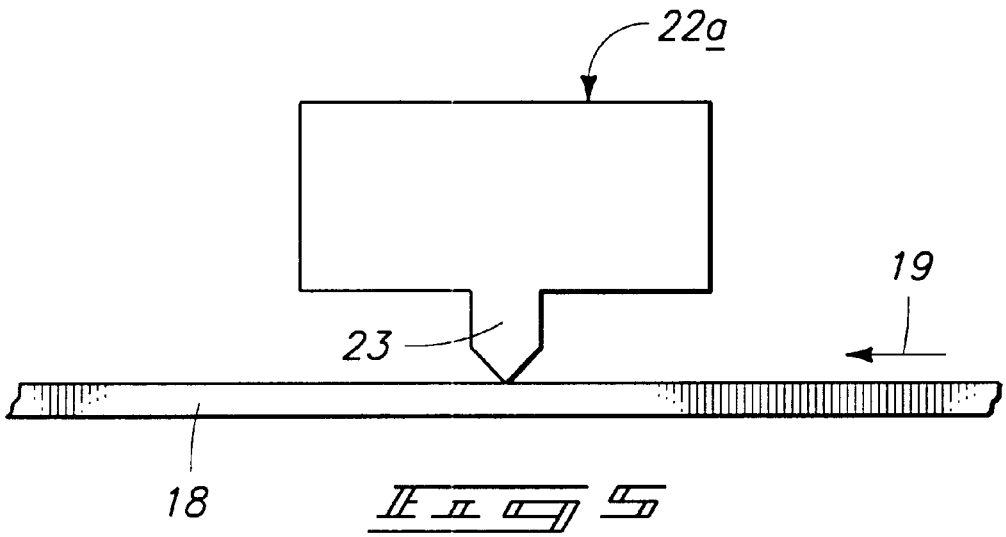
FIG. 5 is an illustrative representation of a first sensor configuration provided upstream of the imaging assembly.

Referring specifically to FIG. 5, sensor configuration 22*a* is configured to monitor a qualitative characteristic of the media including the surface roughness or surface finish of media sheet 18. For example, sensor 22 can comprise a surface-profiling device 23, such as a stylus, operable to contact an upper surface of media sheet 18 traveling along media path 32 of FIG. 2 in a direction indicated by arrow 19. Sensor configuration 22*a* is preferably positioned to monitor the printed side of media sheets 18. Piezoelectric devices may be utilized within sensor 22*a* to generate voltages responsive to the movement of profiling device 23 corresponding to the surface finish of media sheet 18.

As media sheet 18 passes adjacent sensor 22*a*, profiling device 23 follows irregularities upon the surface of media sheet 18 and voltages are generated that are proportional to the height of the irregularities. Signals outputted from sensor 22*a* representing media roughness or smoothness may be applied to conditioning circuit 70 and system controller 72 of control circuitry 30. As described in detail below, system controller 72 can output control signals to fuser controller 74 to control fusing operations within fuser 28 responsive to the surface finish of media sheet 18.

Relatively smooth media, such as overhead transparencies, have been observed to produce low amplitude voltage outputs. Normal finish paper, such as 16-pound Badger Bond media, has resulted in medium amplitude voltage outputs. It has also been observed that rough finish papers, such as Neenah Classic Laid media, result in a relatively large amplitude voltage output from sensor 22*a*.

Figure 6:
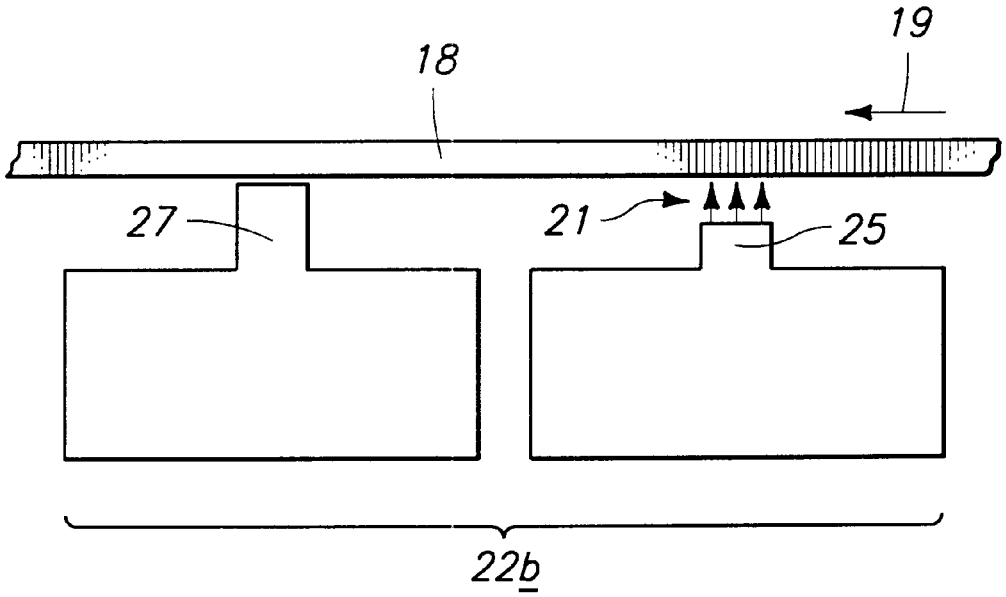
FIG. 6 is an illustrative representation of another sensor configuration.

Referring to FIG. 6, another sensor configuration 22*b* is illustrated for monitoring another qualitative characteristic or property of media sheet 18 for use in controlling fusing operations. The illustrated configuration of sensor 22*b* includes a heat source 25, such as a resistor, and a temperature sensing device 27, such as a thermocouple. Sensor 22*b* can be utilized to monitor heat capacity and thermal conductivity of media sheet 18.

Heat source 25 and temperature sensing device 27 are placed along media path 32 of FIG. 2 upstream of fuser 28 in the depicted configuration. Media sheet 18 traveling along media path 32 in a direction indicated by arrow 19 passes sensor 22*b*. Heat source 25 is configured to impart heat flux 21 to media sheet 18 in the depicted embodiment. Temperature sensing device 27 is positioned downstream of heat source 25 and is configured to monitor the temperature of media sheet 18.

As media sheet 18 passes sensor 22*b*, heat source 25 contacts media sheet 18, thereby raising the temperature of media sheet 18. Temperature sensing device 27 downstream of heat source 25 measures the temperature of media sheet 18 in the same downstream lateral location of media sheet 18. The temperature of media sheet 18 as measured within temperature sensing device 27 reflects properties of media sheet 18 that may affect fusing quality.

Sensor 22*b* outputs a signal having a voltage which corresponds to the temperature of the media sheet 18 as measured by temperature sensing device 27. A signal can be forwarded to conditioning circuitry 70, system controller 72 and fuser controller 74 for adjusting operation of fuser 28 responsive to the temperature of media sheet 18. The temperature is indicative of qualitative characteristics such as heat capacity and thermal conductivity of media sheet 18.

In another configuration, fusing roller 66 is utilized as the heater 25 of sensor 22*b*. Temperature sensing device 27 is located downstream of fusing roller 66 to monitor the temperature of media passing fuser 28 in such a configuration. Such alternate position of temperature sensing device 27 is shown in phantom in FIG. 2.

A signal outputted from sensor 22*b* could similarly be applied to system controller 72 and fuser controller 74 for controlling fusing operations. Such a configuration could be utilized to adjust fusing operations following the passage of a portion of a media sheet 18 through fuser 28. Fusing operations upon the remaining portions of the media sheet 18 could be performed responsive to the output of sensor 22*b*. In addition, sensor 22*b* could be provided adjacent the top side of media sheet 18 or the bottom side of media sheet 18 depending upon fabrication designs of image forming device 10.

Figure 7:
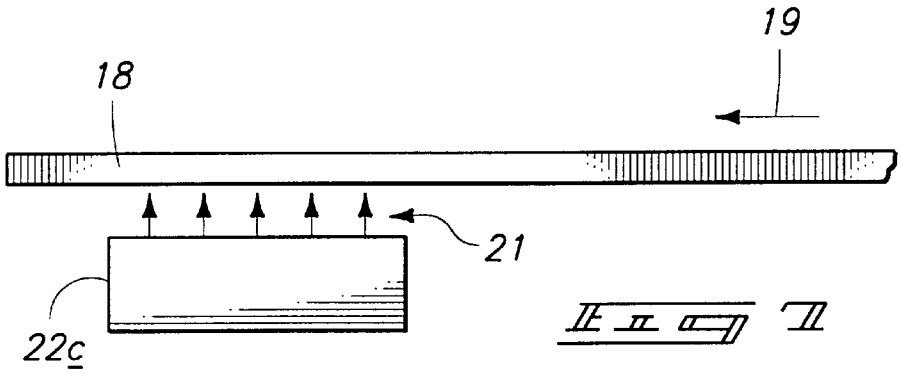
FIG. 7 is an illustrative representation of a third sensor configuration.

Referring to FIG. 7, another sensor configuration 22*c* is illustrated. The depicted sensor 22*c* is advantageously positioned adjacent media path 32 of FIG. 2 to monitor a qualitative characteristic of media sheet 18 passing thereby in a direction indicated by arrow 19. The depicted sensor 22*c* comprises a positive-temperature-coefficient (PTC) thermistor which may be utilized as a heater. A PTC thermistor possesses the desirable characteristic of self-regulating its temperature when a voltage is applied across the PTC thermistor.

More specifically, for a constant applied voltage and once the PTC thermistor has reached an operating temperature, the current flowing within the PTC thermistor is that necessary to maintain a particular temperature. If the media sheet 18 is positioned in favorable thermal contact with the PTC thermistor sensor 22*c* and moved across at a constant rate, a heat flux 21 from the heater to the paper is developed whose magnitude is related to the velocity, the temperature difference and the heat capacity and thermal conductivity of the media.

Accordingly, by measuring the change in current flowing through the PTC thermistor sensor 22*c* when media sheet 18 is present and absent, a measure of the media's heat capacity and thermal conductivity may be accomplished and used to set an effective temperature of fuser 28.

Figure 8:
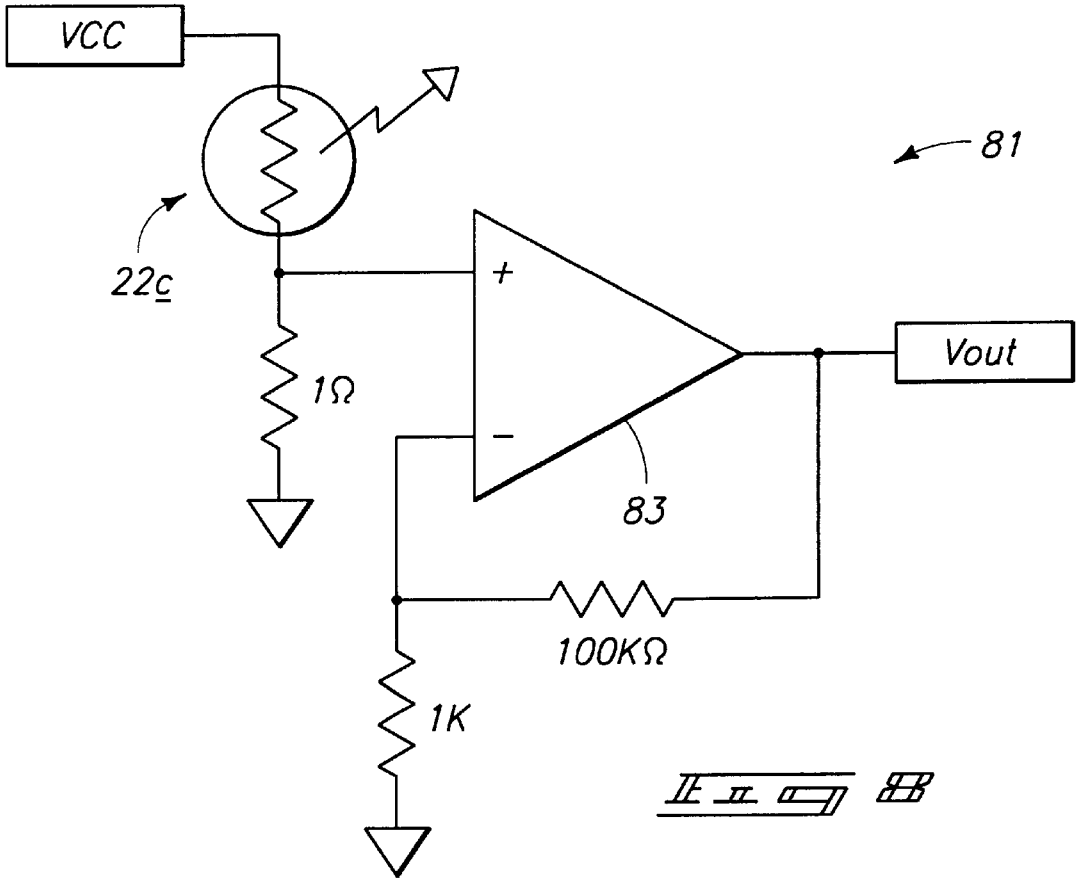
FIG. 8 is a schematic representation of an exemplary current sensing circuit for the sensor configuration of FIG. 7.
Figure 6:
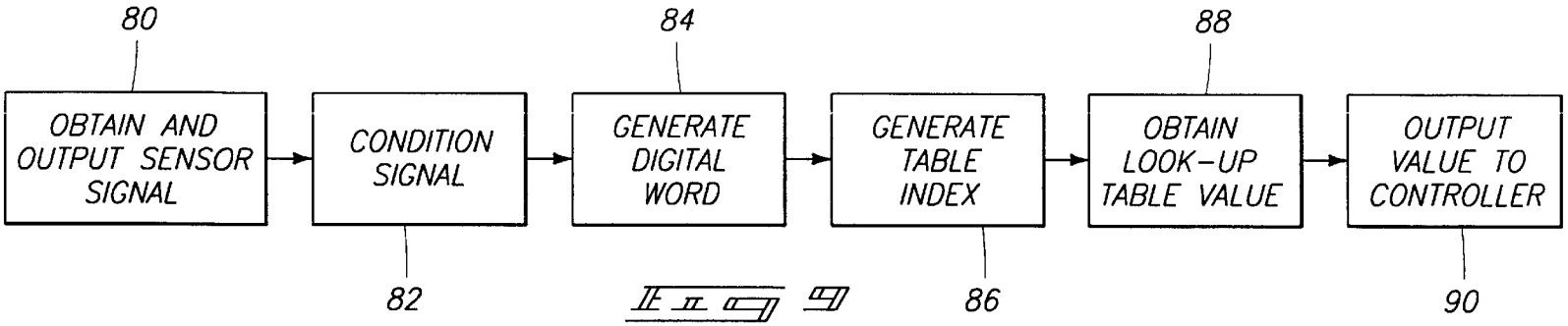

Referring to FIG. 8, a current sensing circuit 81 for use with sensor configuration 22*c* is shown. Sensor configuration 22*c* comprising a PTC thermistor is coupled with a $V_{cc}$ voltage reference and an amplifier 83 arranged as shown. By measuring a change in current flowing through the PTC thermistor sensor configuration 22*c* when media is and is not present, a measure of the media's heat capacity may be accomplished and used to set an effective fuser temperature for fuser 28. Current sensing circuit 81 measures the current of sensor configuration 22*c* and converts the current into voltage at $V_{out}$ which may be read by an analog-to-digital converter of system controller 72. Current sensing circuit 81 outputs a signal of 101 Volts/Ampere to system controller 72 in the described configuration.

Referring to FIG. 9, operations for controlling a fusing parameter of fuser 28 are described. The fusing parameter is controlled responsive to monitoring of a qualitative characteristic of the media in accordance with an aspect of the present invention.

Initially, sensor values of the appropriate sensor(s) 22*a*–22*c* are obtained as represented by step 80. Signals corresponding to such values can be generated responsive to a stylus following the surface profile of the media, or monitoring of the temperature of the media following selective heating in exemplary configurations. The sensor values can be outputted from the appropriate sensor configuration as characteristic signals.

The characteristic signals are applied to conditioning circuitry 70 to provide conditioning of the characteristic signals at step 82. Exemplary conditioning includes filtering to remove extraneous spikes, as well as changing the format of the outputted signals. For example, varying current value signals (e.g., corresponding to current applied to the PTC thermistor of sensor configuration 22*c*) can be converted to varying voltage value signals within conditioning circuitry 70 using current sensing circuit 81 in accordance with one configuration.

Thereafter, digital words are generated corresponding to the conditioned signals in step 84. In one configuration, system controller 72 includes an analog-to-digital converter (ADC) to generate digital words responsive to conditioned signals from circuitry 70. System controller 72 can execute instructions to generate table indices from the digital words in step 86. Responsive to the generation of the table indices, look-up table values can be retrieved from memory 73 at step 88. The values can be empirically derived look-up table values for providing optimum fuser settings to fuser controller 74 responsive to the digital words and table indices. At step 90, the determined look-up table values are provided to an appropriate controller comprising fuser controller 74 for control of fuser 28.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging forming device comprising:

a housing configured to guide media in a downstream direction along a media path;

an input device configured to receive an image;

a developing assembly adjacent the media path and configured to provide developing material;

a sensor adjacent the media path and configured to monitor heat capacity of the media and to generate a signal indicative of the monitoring;

a fuser adjacent the media path and configured to adjust a fusing parameter and to fuse the developing material corresponding to the image to the media according to the fusing parameter; and control circuitry configured to receive the signal from the sensor and to control adjustment of the fusing parameter of the fuser responsive to the signal.

2. The image forming device according to claim 1 wherein the fusing parameter is fusing temperature.

3. The image forming device according to claim 1 wherein the sensor is configured to monitor thermal conductivity of the media.

4. The image forming device according to claim 3 wherein the fusing parameter is fusing temperature.

5. The image forming device according to claim 1 wherein the sensor includes:

a heat source configured to impart heat flux to the media; and a temperature sensing device positioned downstream of the heater adjacent the media path and configured to monitor the temperature of the media.

6. The image forming device according to claim 5 wherein the fuser includes the heat source.

7. The image forming device according to claim 1 wherein the sensor is configured to determine the qualitative characteristic including surface finish of the media.

8. The image forming device according to claim 7 wherein the fusing parameter is fusing temperature.

9. The image forming device according to claim 1 wherein the sensor comprises a stylus.

10. The image forming device according to claim 1 wherein the sensor comprises a positive-temperature-coefficient thermistor.

11. The image forming device according to claim 1 wherein the control circuitry is configured to execute instructions.

12. A fusing assembly adjacent a media path of an image forming device comprising:

a sensor configured to monitor heat capacity of media traveling in a downstream direction along a media path of an image forming device and to generate a characteristic signal responsive to the monitoring;

a fuser configured to fuse developing material to the media according to a fusing parameter; and control circuitry configured to receive the characteristic signal from the sensor and to output a control signal responsive to the characteristic signal to the fuser to adjust the fusing parameter.

13. The fusing assembly according to claim 12 wherein the fusing parameter is fusing temperature.

14. The fusing assembly according to claim 12 wherein the sensor includes:

a heat source configured to impart heat flux to the media; and a temperature sensing device positioned downstream of the heater adjacent the media path and configured to monitor the temperature of the media.

15. The fusing assembly according to claim 14 wherein the fuser includes the heat source.

16. A fusing assembly adjacent a media path of an image forming device comprising:

a positive-temperature-coefficient thermistor configured to monitor media traveling in a downstream direction along a media path of an image forming device and to generate a characteristic signal responsive to the monitoring;

a fuser configured to fuse developing material to the media according to a fusing parameter; and a controller configured to receive the characteristic signal from the sensor and to output a control signal responsive to the characteristic signal to the fuser to adjust the fusing parameter.

17. The fusing assembly according to claim 16 wherein the fusing parameter is fusing temperature.

18. The fusing assembly according to claim 16 wherein the sensor is configured to monitor heat capacity of the media.

19. A method of forming an image upon media comprising:

providing an image forming device;

fusing developing material to media corresponding to an image to be imaged and according to a fusing parameter using the image forming device;

monitoring heat capacity of the media;

outputting a signal indicative of the monitoring;

adjusting the fusing parameter; and controlling the adjusting using control circuitry responsive to the outputting.

20. The method according to claim 19 wherein the fusing comprises fusing according to the fusing parameter comprising fusing temperature.

21. The method according to claim 19 wherein the monitoring comprises determining thermal conductivity of the media.

22. The method according to claim 21 wherein the monitoring comprises:

imparting heat flux to the media; and sensing the temperature of the media following the imparting.

23. The method according to claim 19 wherein the monitoring comprises monitoring using a positive-temperature-coefficient thermistor.

24. The method according to claim 19 further comprising monitoring surface finish of the media, and the controlling is responsive to the monitoring of the surface finish.

25. The method according to claim 24 wherein the fusing comprises fusing according to the fusing parameter comprising fusing temperature.

* * * * *